United States Patent [19]

Lerude et al.

[11] Patent Number: 4,506,245

[45] Date of Patent: Mar. 19, 1985

[54] REVERSING DEVICE WITH ELECTROMAGNETIC CONTROL AND MECHANICAL LOCKING

[75] Inventors: Gérard Lerude, Poitiers; Jacques Lesoile, Mirebeau, both of France

[73] Assignee: La Telemecanique Electrique, France

[21] Appl. No.: 466,197

[22] Filed: Feb. 14, 1983

[30] Foreign Application Priority Data

Feb. 12, 1982 [FR] France ..... 82 02353

[51] Int. Cl.[3] ..... H01H 9/26

[52] U.S. Cl. ..... 335/160; 200/50 C

[58] Field of Search ..... 335/160, 161; 200/50 C

[56] References Cited

U.S. PATENT DOCUMENTS

| | | | |
|---|---|---|---|
| 3,210,491 | 10/1965 | Marco | 335/160 |
| 3,243,544 | 3/1966 | Mayer | 335/162 |
| 3;919,675 | 11/1975 | Degenhart et al. | 335/160 |
| 4,345,225 | 8/1982 | Lemmer | 335/132 |

*Primary Examiner*—E. A. Goldberg
*Assistant Examiner*—George Andrews
*Attorney, Agent, or Firm*—William A. Drucker

[57] ABSTRACT

Reversing contactor with mechanical locking. The casing (2) of the device includes a half-casing (3) to which are coupled two identical covers (70, 71), each of which closes one of two housings (9, 10), each of which receives the fixed and movable pieces of an electromagnet and the corresponding sets of contacts (49, 50). Such a contactor, which lends itself especially well to compact production, is used to change the direction of a motor with every guarantee of safety.

4 Claims, 6 Drawing Figures

P
6
8
107
2
3 70 71
5
7
85
36
3
4
69
53
55
84
89
54
10
14
88
9
110
112
111
86
87
104
103
102
99 97 101
113

23 70_71 26 21 43 72 73
1
107
3
2
G
6
70_71
109
19_20
R
R'
108
13 7 53 56 69 106 67 51 35 105
57
54

REVERSING DEVICE WITH ELECTROMAGNETIC CONTROL AND MECHANICAL LOCKING

BACKGROUND OF THE INVENTION

1. Field of the Invention

The invention relates to a reversing device with electromagnetic control. It has two identical contactor systems each equipped with an electromagnet with a fixed yoke, a coil and a movable armature coupled to a set of switches whose fixed contacts are connected to terminals. There is a mechanical locking device which uses two levers, the first ends of which are coupled to the armatures, while the other ends move alternately in a common area that can be occupied only by one of the other ends.

Such devices are frequently used in installations where the direction of a motor is changed by reversing the order of the phases, and where there is a need to improve, by other means, the safety of the reversal provided by an electrical locking circuit.

2. Description of the Prior Art

The known devices are generally produced by electrically coupling two tripolar contactors either between which or beside which there is a subset of mechanical locking that contains the two above-mentioned levers.

Such a means of production can only meet all requirements if the manufacturing tolerances of the contactors and of the locking subset are kept within relatively narrow limits so that the cumulative total of the tolerances does not exceed those which guarantee that the overall devices works properly.

Moreover, when a locking subset is placed between two contactors, there is a loss in that spot of a place that is generally attributed either to contactor terminals or to other similar devices fixed in that area. Yet, if the subset is arranged parallel to two neighboring contactors, there are even greater mechanical coupling difficulties between it and the contactors because of the uncertainty of position that is given to these devices by the assembly personnel when they mount them on the same holder.

OBJECTS OF THE INVENTION

It is an object of the invention to supply a switch-reversal device with the general composition mentioned above, but one in which steps shall be taken so that the user does not have to assemble the device in such a way as to comply with precise respective positions and so that factory assembly as well as verification of proper operation may be made significantly easier.

According to the invention, the device is contained in a casing comprised of a half-casing that includes all of the output terminals of the two sets of switches and, has two identical and parallel internal housings that are each able to receive and guide a contact support member of the contactor and an armature coupled to it, as well as means of pivoting for the two levers placed on a lateral wall between one area that receives a row of output terminals in a line and another area with at least a portion of the fastening base of the device, the half-casing being coupled to two identical covers, each of which includes the input terminals of a corresponding switch set and each able to close one of the housings by completing the guidance of the contact support member, with the covers coupled to the half-casing along a joint plane in which the two armatures move to a great degree.

Other particulars of the invention, the objectives of which are especially to improve the rigidity of the casing and the accessibility to the electromagnet coils, appear more clearly through the detailed description that follows.

DESCRIPTION OF THE PREFERRED EMBODIMENT

Figure 1:
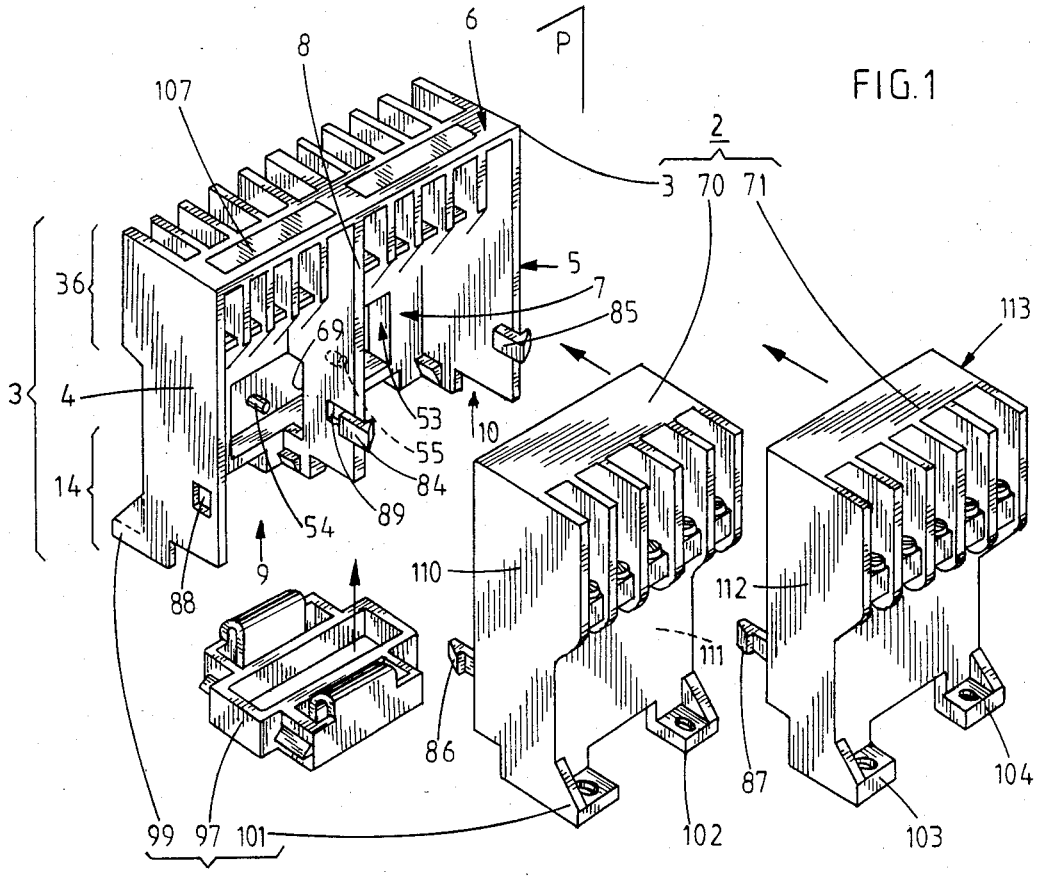
FIG. 1 represents a drawing in split perspective of the components of the casing in the device.

The principal elements of a casing 2 of a switch reversing device 1 according to the invention are especially visible in FIG. 1, in which reference 3 relates to a half-casing with largely lateral walls 4, 5 and two longitudinal walls 6, 7. These lateral walls, as well as a central partition 9 extend to a plane P which limits them and are perpendicular to the plane, while the longitudinal wall 7 is essentially parallel to it.

Between the walls 4, 5 and the central partition 8 are two identical housings 9, 10 (see also FIG. 2), the lower volumes 11, 12 of which are next to a fastening base 13 located in a lower area 14 of the half-casing 3 and receive respectively movable and fixed elements of the two electromagnets 15, 16, while upper volumes 17, 18 of these housings receive respectively a contact support member 19, respectively 20, as each of them is connected to a respective movable armature 21, 22; each electromagnet still has (in the known manner) a fixed yoke 23, 24, a coil 26, 42 and a reset spring 27, 28.

In each upper volume there are fixed contacts such as 29, 30 respectively 31, 32 (see FIG. 2) which are separated by internal insulating partitions, such as 33, 34 respectively.

The fixed contacts are connected to output terminals 35 in a row, placed outside the half-casing and thus outside the two housings in an upper area 36 of the half-casing. The output terminals are separated by insulating ribs 37 (see FIGS. 5 and 6) and include power terminals 38, 38′ and relay terminals 110, 110′, as well as coil terminals 39, 39′. The coil terminals end at internal contact pieces 40, 41 respectively, which are in elastic contact with one of the two ends of the winding of each coil 26, 27 respectively (see FIG. 2).

Each armature 21, 22 is connected to the corresponding contact support member by a transverse rib 43, 44 in comparison to the plane P, and their movements are guided in plane P by the contact support members working together with the internal paritions 33, 34 respectively.

Each contact support member 19, 20 carries movable bridge contacts such as 45, 46 respectively, and such as 47, 48 respectively.

The three contact bridges such as 45 and 46 work together with the corresponding fixed contacts 29, 30 of the half-casing to form off switches T, while the contact bridges such as 47 and 48 work together with corresponding fixed contacts 31, 32 to form on switches R. Each contact support member 19, 20 activates a particular set of switches 49, 50 respectively.

Figure 5:
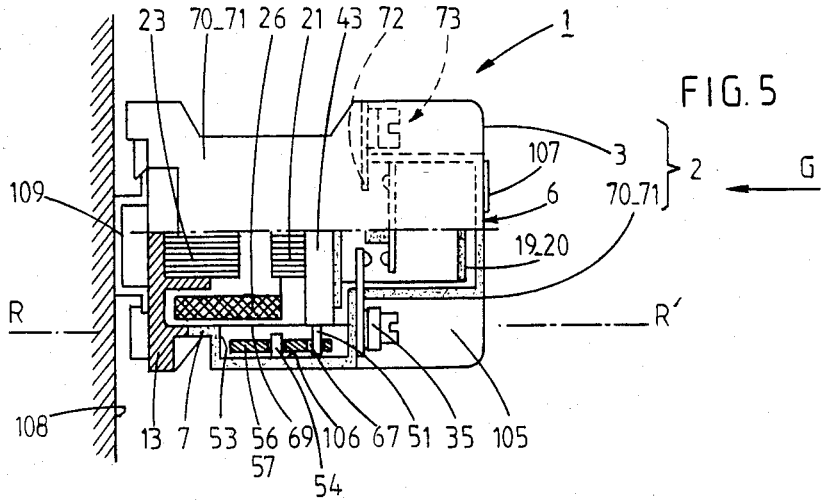
FIG. 5 is a half-section of the device intersected by a broken plane SS′ defined in FIG. 2.
Figure 3:
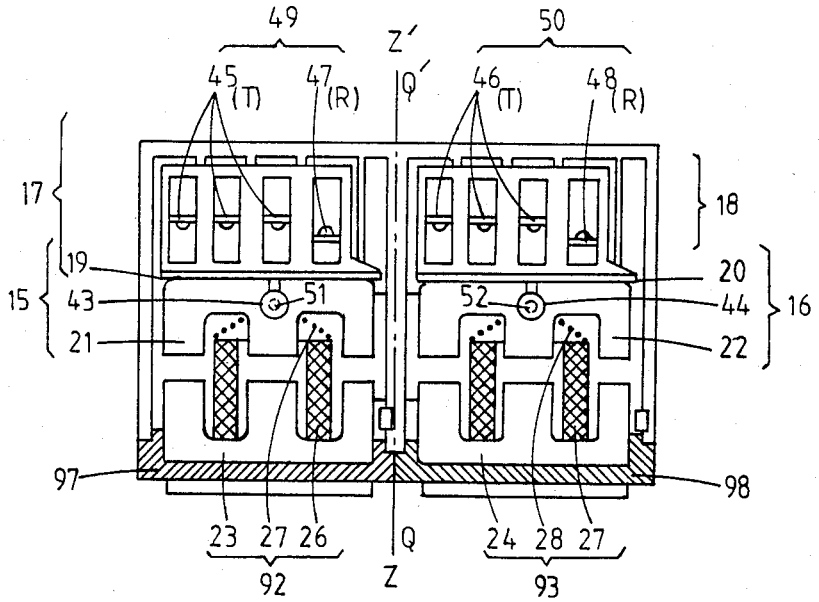
FIG. 3 is a section similar to that of FIG. 2, but the electromagnets and the contact support members are shown.

Each rib 43, 44 of the contact support members 19, 20 respectively has a transverse pin 51, 52 respectively, that moves along with the corresponding armature in a movement parallel to an axis ZZ' (see FIGS. 5 and 3).

Figure 2:
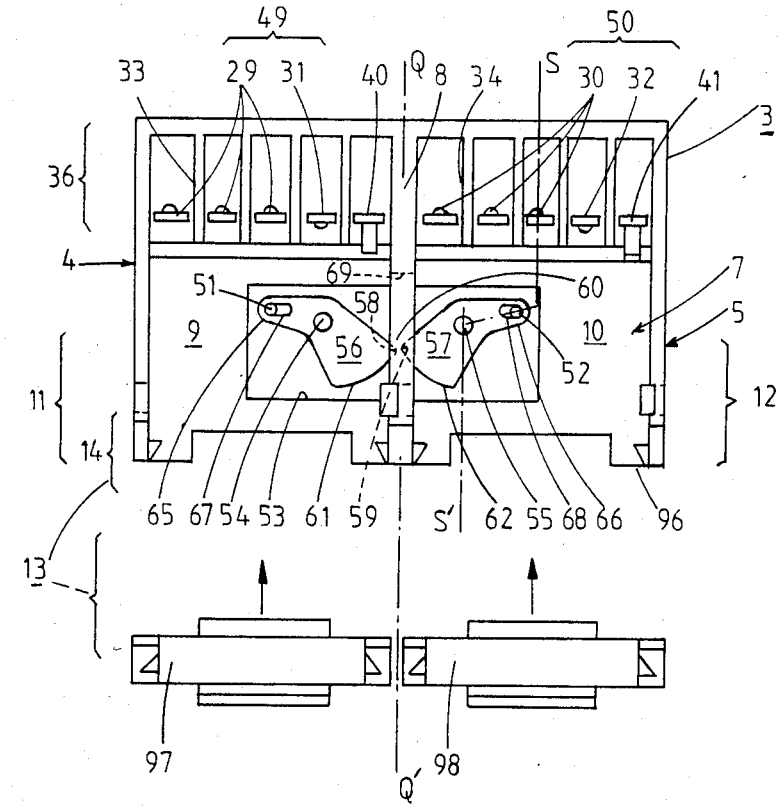
FIG. 2 is a vertical section of the half-casing of the device, directed toward the inside, without an electromagnet.

The longitudinal wall 7 has a longitudinal cavity 53 located between one area 36 which receives the terminals and fixed contacts and another area 14 in the neighborhood of the base 13 (see FIGS. 2 and 1).

The cavity has two studs 54, 55 that are perpendicular to plane PP', on which two reciprocal mechanical locking levers 56, 57 are pivoted.

The levers, in a known manner, have on one set of ends 63, 64, two edges 58, 59 respectively, placed near one another in the same area 60 and two curved support surfaces 61, 62 respectively, while the other opposite ends 65, 66 each have an oblong opening 67, 68 respectively, which is able to work with one of the rib pins 51, 52 respectively (see also FIG. 5).

When an armature moves in a parallel direction to axis ZZ' toward the bottom of FIG. 2, a corresponding locking lever puts its support surface opposite the edge of the other locking lever, which prevents the other from moving in a parallel direction since a notch 69 of the central partition 8 set opposite the cavity 53 enables the two levers to work together (see FIGS. 5 and 1).

When the armatures of both electromagnets 15, 16 and the equipped contact support members 19, 20 are placed in the respective housings, they are capped by covers 70, 71 respectively (see FIGS. 1 and 5) which have a shape identical to that which would be obtained by sectioning the half-casing 3 through a median plane QQ' passing through the central partition 8; however, there are no holes on the covers as they would be useless for their function of closing the housings. Each of the covers complements guidance of an armature and of a contact support member and has fixed contacts such as 72 which work together with the contact bridges and input terminals in rows 73 connected to the fixed contacts (see FIG. 5, 1 and 6).

Figure 6:
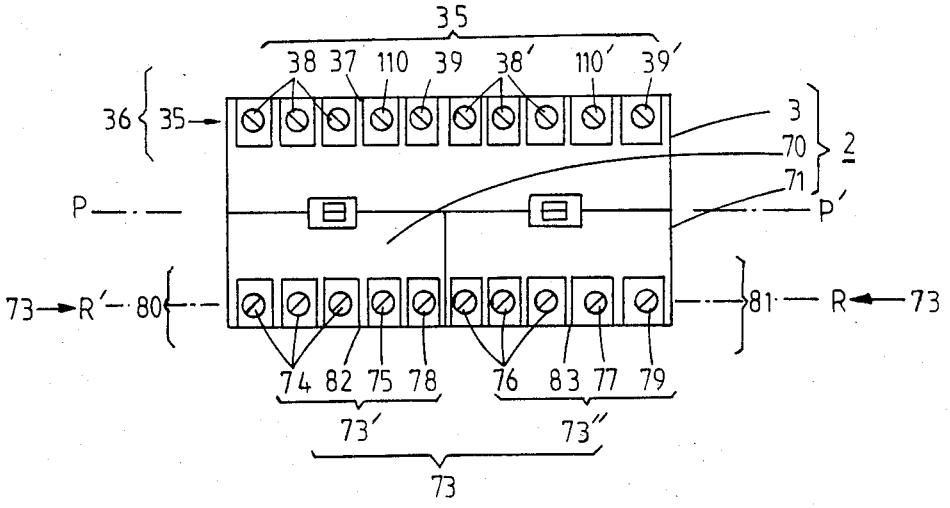
FIG. 6 represents a frontal view of the complete device observed in the direction of arrow G.

The input terminals 73 on the one hand are divided into terminals 73', 73'' for each cover, and, on the other hand, into power and relay terminals 74, 75 and 76, 77 respectively, and into coil terminals 78, 79 in a manner similar to those of the half-casing and are thus placed in the upper areas 80, 81 respectively, of the covers 70, 71 respectively, divided by insulating partitions 82, 83 (see FIG. 6).

The covers are thus applied on the half-casing along plane PP', which represents a joint plane and are an integral part of it owing to elastic hooks 84, 85, 86, 87 and to slots or openings 88, 89, 91, held by partitions 4, 8, 5 respectively, 100, 111, 112, 113 of these three pieces in a complementary and symmetrical manner.

During assembly, the half-casing 3 is equipped with the fixed contacts, the coil pieces, the output terminals, the two levers and the equipped contact support members, then with the covers themselves equipped with fixed contacts and input terminals, are coupled to the half-casing.

Figure 4:
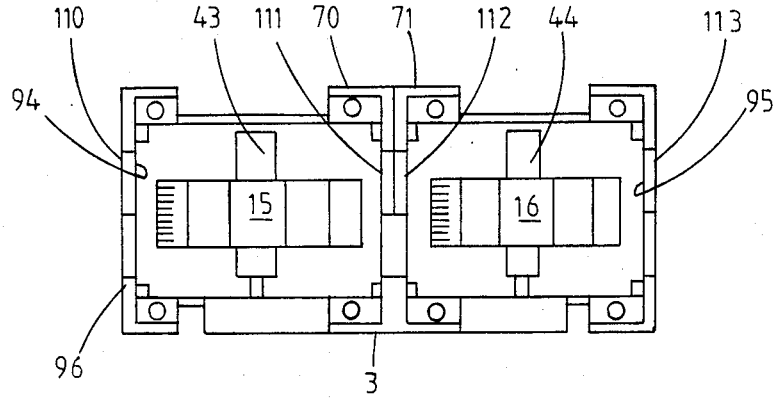
FIG. 4 represents a section of the casing from the bottom, without the two fastening base members.

Once this first stage of assembly is complete, the fixed components 92, 93 of each electromagnet are placed in their respective housings 9, 10 through two openings 94, 95, which still remain in the bottom 96 of the casing 2 between parts 2 and 70, 71 (see FIGS. 4 and 2).

Two base members that can be cogged close these openings 97, 98, which serve to hold respectively the yokes 23, 24 of the electromagnets and also have elastic hooks on the outside that are able to work with a standardized section according to a technique described in French patent application No. 81 17721, filed Sept. 15, 1981, by the Applicant (see FIG. 1, 2 and 3) and published on Mar. 18, 1983 under No. 2,513,007.

The base members, along with the fastening clips such as 99, 100, 101, 102, 103, 104, which go respectively with half-casing 3 and covers 70, 71, constitute the fastening base 13.

As can be better seen in FIG. 5, the locking levers 56, 57 move in a plane RR', parallel to PP' and going into the cavity 53. The RR' plane goes substantially through the pockets 105 where are housed respectively, side by side and in the same order, the output terminals of the same polarity of the two switch sets 49, 50, respectively coupled to each electromagnet, as well as the coil terminals 78 and 79. In order to avoid the tendency of the locking levers to slip along their pivots, it is preferable to place the wall 106 of the cavity 53 that has the studs in a horizontal direction and facing downward. Such a direction may be made necessary by a corresponding direction of the wiring marks 107 borne by the longitudinal wall 6 which becomes a frontal side when the bottom of the base 13 is mounted on a vertical wall 108.

Pieces 3, 70, 71, 97 and 98 may each be produced to great advantage from just one piece by using a thermoplastic material to cast them. This makes it possible to provide the guidance surfaces (which ensure that the contact support members have a sliding motion) and pivots 54, 55 of the locking levers with positions that are free of faults. The finished product has excellent rigidity which is largely the result of a number of elastic hooks. Further improvements are obtained when the fastening base members are coupled to a fastening section 109.

We claim:

1. An electromagnetic control device comprising:

(a) first and second substantially identical contactor units, the first contactor unit having a first plurality of switches and a first electromagnet including a first fixed yoke, a first coil and a first armature movable along a predetermined direction, the second contactor unit having second plurality of switches and a second electromagnet including a second fixed yoke, a second coil and a second armature movable along the said predetermined direction, each of the switches of the first and second plurality having stationary contacts and movable contact bridges; first and second contact carriers respectively coupling the first and second movable armatures to the movable contact bridges of the said first and second pluralities of switches; first and second sets of aligned terminals, each set including the terminals of a given polarity connected both to the first and second pluralities of switches;

(b) mechanical locking means comprising first and second levers mounted for pivoting in opposite directions and each having first and second ends, and means for coupling the respective first ends of the said levers to the first and second movable armatures respectively, whereby the respective lever is pivoted to an actuated position when the respective movable armature is displaced from a rest position to an actuated position, the second end of each lever being prevented from reaching its actuated position by the second end of the other lever when the said other lever is in its actuated position;

(c) a generally parallelepipedic half-casing having first and second side walls substantially parallel to said predetermined direction, an open face substantially at right angles to said side walls and a further wall opposite said open face, said side walls defining therebetween first, second and third adjacent, elongate volume portions, the second volume being located intermediate the first and third volume positions and delimited by an outwardly protruding surface portion of the said further wall; a plurality of insulating partitions outwardly and inwardly extending from the said further wall opposite the third volume portion, said insulating partitions which are substantially parallel to said side walls, outwardly defining a plurality of lodgings for the first set of terminals and inwardly defining a further plurality of lodgings; a central insulating partition inwardly extending from the said further wall substantially parallel to said side walls and dividing the internal volume of the half-casing into first and second housings each comprising half of the said first, second and third volume portions; and an aperture within said central insulating portion, said aperture opening on the said protruding surface portion;

(d) first and second means for respectively guiding the displacement of the first and second contact carriers within the first and second respective third half-volume portions and the displacement of the first and second armatures within the first and second respective second half-volume portions;

(e) means for pivotally mounting the first and second levers respectively in the cavities delimited by the said protruding surface portion within the two respective second-half volume portions, the second ends of the levers passing through the said aperture;

(f) means for mounting the first and second yokes and coils in the respective first and second halves of the first volume portion;

(g) first and second half-covers, each of generally parallelepipedic shape and having first and second side walls, an open face substantially at right angles with said walls and a further wall opposite said open face, solid side walls defining therebetween first, second and third adjacent elongate half-volume portions, the second half volume portion being located intermediate the first and third half-volume portions; a plurality of insulating partitions, outwardly and inwardly extending from the said further wall opposite the third half-volume portion, said insulating partitions which are substantially parallel to said side walls, outwardly defining a plurality of lodgings for the second set of terminals and inwardly defining a further plurality of lodgings, the said stationary contacts and the movable contact-bridges being housed in the further pluralities of lodgings of the said half-casing and of the first and second half-covers;

(h) means for attaching the first and second half-covers to the half casing, with the open faces of the respective half covers in engagement with the open face of the half-casing opposite the respective first and second housings; and the respective volume portion of the half-covers forming closed volumes with the respective volume portions of the half-casing and, (i) fastening base means attached to the half-casing and the two half-covers, in the first volume portions thereof.

2. An electromagnetic control device as claimed in claim 1, wherein the said means are pivotally mounting the said levers comprise studs integrally connected to the said outwardly protruding surface portion.

3. An electromagnetic control device as claimed in claim 1, wherein the respective side walls of the half-casing and of the first and second half-covers are fitted with resilient hooking means which form the said means for attaching the first and second half-covers to the half-casing.

4. An electromagnetic control device as claimed in claim 1, wherein the said fastening base means comprise first and second snap fixing members which are attached to the half-casing and, respectively, to the first and second half-covers, said first and second snap-fixing members respectively supporting the first and second yokes and having an outer surface and resilient hooks, located on the said outer surface for attachment of the electromagnetic control device on to a supporting profiled section.

* * * * *